US005246907A

United States Patent [19]

Uytterhoeven

[11] Patent Number: 5,246,907

[45] Date of Patent: Sep. 21, 1993

[54] METHOD FOR MAKING TRANSPARENT THERMAL DYE TRANSFER IMAGES

[75] Inventor: Herman J. Uytterhoeven, Bonheiden, Belgium

[73] Assignee: AGFA-Gevaert, N.V., Mortsel, Belgium

[21] Appl. No.: 682,387

[22] Filed: Apr. 9, 1991

[30] Foreign Application Priority Data

Apr. 17, 1990 [EP] European Pat. Off. ..... 90200930.7

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 5,030,538 7/1991 Tobias et al. ..... 430/138

FOREIGN PATENT DOCUMENTS 0233291 10/1987 Japan ..... 503/227

*Primary Examiner*—B. Hamilton Hess

*Attorney, Agent, or Firm*—Breiner & Breiner

[57] ABSTRACT

Method for making a transparent thermal dye transfer image comprising image-wise heating a first dye-donor element comprising a support having thereon a dye-binder layer and transferring a first dye image to a dye-image-receiving layer provided on one side of the transparent film carrier of a receiving sheet, said first dye image having a certain density, and image-wise heating a second dye-donor element comprising a support having thereon a dye-binder layer and transferring a second dye image to a dye-image-receiving layer provided on the outer side of said transparent film carrier of said receiving sheet, said second dye image being of the same hue as that of said first dye image and being in register with said first dye image to increase the density of said first dye image. The invention also provides a receiving sheet for use in thermal dye transfer processes, said receiving sheet comprising a transparent film carrier provided on either side with a transparent dye-image-receving layer.

9 Claims, 3 Drawing Sheets

METHOD FOR MAKING TRANSPARENT THERMAL DYE TRANSFER IMAGES

BACKGROUND OF THE INVENTION

1. Field of the Invention

The present invention relates to a method for making transparent thermal dye transfer images having an enhanced density and to a receiving sheet for use according to that method.

2. Description of the Prior Art

Transparent receiving sheets are used for making transparencies by thermal dye transfer processes. The carrier of such receiving sheets is made of a transparent film e.g. of polyethylene terephthalate, a polyether sulfone, a polyimide, a cellulose ester, or a polyvinyl alcohol-coacetal. To avoid poor adsorption of the transferred dye to the film carrier the latter must be provided with a special surface, generally known as dye-image-receiving layer, into which the dye can diffuse more readily. This dye-image-recieving layer should also be transparent, of course. The adhesion of the dye-image-receiving layer to the film carrier can be improved by providing a transparent subbing layer in between.

Black-and-white and/or colour transparencies can be made by printing with an adapted dye-donor element. The transparencies can find wide application in such different fields like i.a. the field of graphic arts and the medical diagnostical field.

For the production of colour transparencies use is made of dye-donor elements comprising repeated separate areas of different dyes, which are heated up sequentially in correspondence with the cyan, magenta, yellow, and possibly black electrical signals, so that dye from the selectively heated regions of the dye-donor element is transferred to the transparent receiving sheet and forms a pattern thereon, the shape and density of which are in accordance with the pattern and intensity of the heat supplied to the dye-donor element. Depending on the number of different dye areas used, 3 or 4 passages are necessary to print the different dyes in register.

For the production of monochromic transparencies use is made of dye-donor elements that have but one dye area. For the production of black-and-white transparencies use is made of dye-donor elements having a black dye area. Instead of a black dye a mixture of dyes can also be employed, which mixture is then chosen such that a neutral black transfer image is obtained. It is of course also possible to produce a black image by printing from several dye areas one dye over the other and in register. However, this procedure is less suitable because it is more time-consuming and needs a higher length of donor element.

The transmission density of transparencies produced hitherto according to known thermal dye transfer methods is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field such as video imaging a transmission density of at least 2.5 is desired.

One way to increase the density of a transferred image is to merely increase the amount of dye in the dye-donor element and also to increase the amount of power used to transfer the dye. However, this is costly in terms of material and power requirements. Moreover, it is difficult to coat higher amounts of dye in the dye-binder layer. Furthermore, increasing the power to the thermal head generally causes deformation of the receiving sheet.

Another way to increase the density of a transferred image is to lower the amount of binder in the dye-donor element, thereby lowering the path length of the diffusing dye and increasing the dye transfer efficiency. However, when the content of dye in the dye-binder layer is enhanced, the dye tends to crystallize during storage of the dye-donor element. Moreover, the dye-donor element having an enhanced content of dye tends to stick to the receiving sheet during the printing operation.

Other ways to increase the density of the transferred image are to either find new dyes that have higher thermal dye efficiency or find materials that can be added to the dye-binder layer to increase the transfer efficiency in case transparencies are to be made. This would mean, however, that for making transparencies different dye-donor elements would be required than for making reflection prints. Such measure would result in increased manufacturing costs and inconvenience to the user.

In U.S. Pat. No. 4,833,124 a process has been described for increasing the density by printing twice or several times in register on one side of a receiving sheet. Unfortunately, this procedure suffers from several important disadvantages. It needs a considerable length of donor element. It is very time-consuming since it involves repeated passages of the receiving sheet along the thermal printing head. Moreover, only limited increases in density can be accomplished because the dye-image-receiving layer of the receiving sheet is saturated for the greater part by the dye transferred during the first passage and as a result of said dye saturation accepts far less dye during the next passage(s). Furthermore, during passage of the dye-image-receiving layer for the second time or subsequent times along the thermal printing head the already transferred dye partially migrates back to the dye layer. Thus, the density of the transferred dye image only increases in a limited way during the second and especially during further passages.

It would be desirable to provide a way to increase the density of transferred images in thermal dye transfer processes without suffering from the above-mentioned disadvantages.

SUMMARY OF THE INVENTION

It is therefore an object of the present invention to provide a method for making transparent thermal dye transfer images having an enhanced transmission density and to provide a receiving sheet for use according to that method.

This and other objects are achieved by providing a method for making a transparent thermal dye transfer image comprising:

image-wise heating a first dye-donor element comprising a support having thereon a dye-binder layer and transferring a first dye image to a dye-image-receiving layer provided on one side of the transparent film carrier of a receiving sheet, said first dye image having a certain density, image-wise heating a second dye-donor element comprising a support having thereon a dye-binder layer and transferring a second dye image of the same hue as that of said first dye image to a dye-image-receiving layer provided on the other side of said transparent film carrier of said receiving sheet, such that said second dye image is a mirror image of said first dye image and is in register with said first dye image to increase the density of said first dye image.

The present invention also provides a receiving sheet for use in thermal dye transfer processes, said receiving sheet comprising a transparent film carrier provided on either side with a transparent dye-image-receiving layer.

DETAILED DESCRIPTION OF THE INVENTION

The method for making a transparent thermal dye transfer image according to the present invention comprises:

image-wise heating by means of a thermal printing head controlled by a controlling means a first dye-donor element comprising a support preferably coated on both sides with an adhesive layer, one adhesive layer being covered with a slipping layer to prevent the thermal printing head from sticking to said first dye-donor element, the other adhesive layer at the opposite side of the support being covered with a dye-binder layer, which contains printing dyes in a form that can be released by fusion, sublimation, or vapourization in varying amounts depending on, as mentioned above, how much heat is applied to said first dye-donor element, thereby image-wise transferring dye to a dye-image-receiving layer provided on one side of the transparent film carrier of a receiving sheet to form a transferred first dye image having a certain density, and either simultaneously or not simultaneously with said first image-wise heating, also image-wise heating by means of a second thermal printing head also controlled by said controlling means a second dye-donor element also comprising a support preferably coated on both sides with an adhesive layer, one adhesive layer being covered with a slipping layer to prevent the thermal printing head from sticking to said second dye-donor element, the other adhesive layer at the opposite side of the support being covered with a dye-binder layer, which also contains printing dyes in a form that can be released by fusion, sublimation, or vapourization in varying amounts depending on, as mentioned above, how much heat is applied to said second dye-donor element, thereby image-wise transferring dye of the same hue as that of said first dye image to a dye-image-receiving layer provided on the other side of said transparent film carrier of said receiving sheet to form a transferred second dye image, which is a mirror image of said first dye image and is in register with said first dye image to increase the density of said first dye image.

According to the present invention a transparent thermal dye transfer image is made by:

image-wise heating a first-dye-donor element comprising a dye-binder layer by means of a thermal printing head controlled by a controlling means in such a way that a dye image is transferred in the form of an exact mirror image of an original image to be printed to one of two dye-image-receiving layers coated on opposite sides of the transparent film carrier of a receiving sheet, and image-wise heating a second dye-donor element comprising a dye-binder layer by means of a second thermal printing head also controlled by said controlling means in such a way that a second dye image is transferred in the form of its true-sided or unreverted image, which is identical to said original image to be printed, to the other dye-image-receiving layer on the opposite side of said transparent film carrier of said receiving sheet, said mirror image and said true-sided image being in register to increase the density of the transparent thermal dye transfer image obtained.

In order to accomplish a perfect register of said mirror image and said true-sided image, the first and the second dye-donor elements can be provided with marks for detecting the positions of the transferable dye areas and the video printing device comprising the thermal printing heads is equipped with mark-detecting sensor devices that feed detected mark information to the controlling means. Generally, optically detectable marks that can be detected by a light source and a photosensor are used, the marks being in the form of a light-absorbing or light-reflecting coating and having a preassigned position on the dye-donor elements. The detection marks may also comprise one of the image dyes that are used for the image formation, the detection then being preformed in the visible range. The control of the thermal printing heads by the controlling means is such that the electronic image information needed for printing said first dye image is processed in such a way that a mirror image of the original image is printed and that the electronic image information needed for printing said second dye image is processed such that a true-sided image of the original image is printed in register with said mirror image. The resulting transparent thermal dye transfer image has a considerably enhanced transmission density.

The thermal printer used for making thermal dye transfer images having an enhanced transmission density in accordance with the present invention can be designed in several ways.

Figure 1:
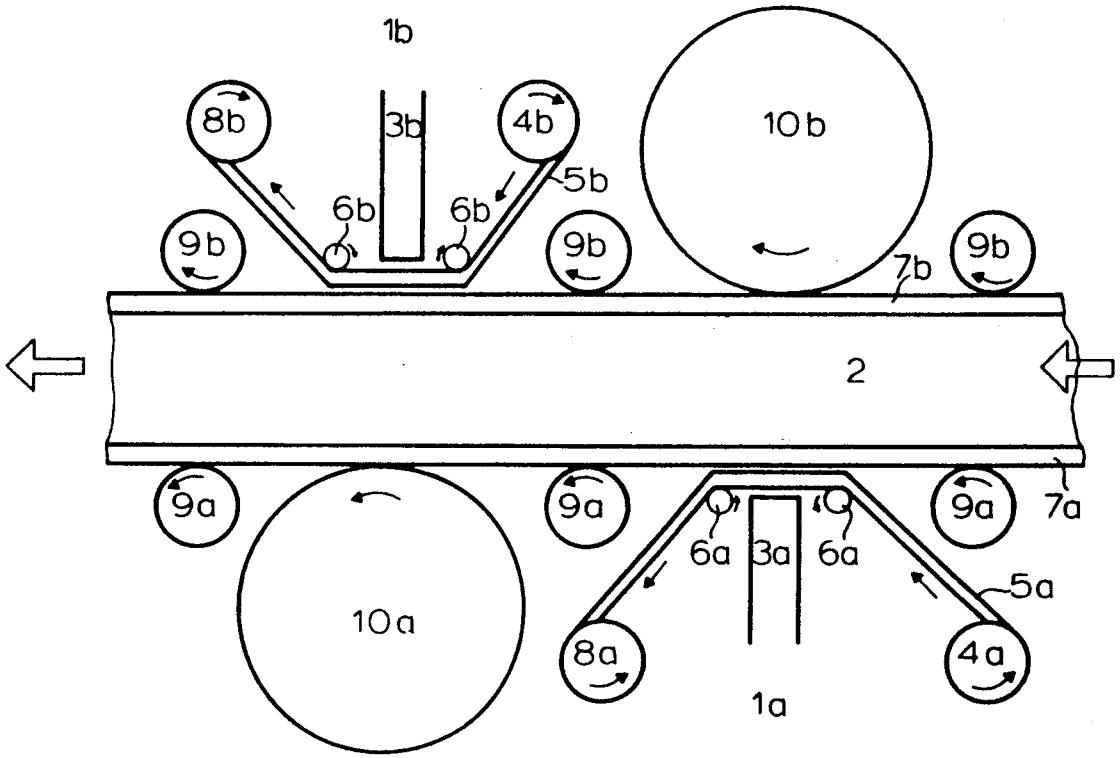
FIG. 1 illustrates schematically a thermal printer comprising two printing stations positioned on opposite sides of a receiving sheet and spaced away from each other.

According to a first alternative the thermal printer is designed as represented in FIG. 1 and comprises two printing stations 1*a* and 1*b* positioned on either side of the receiving sheet 2 at short distance from each other. The printing stations 1*a* and 1*b* comprise thermal printing heads 3*a* and 3*b* respectively, supply rolls 4*a* and 4*b* respectively that feed dye-donor elements 5*a* and 5*b* respectively past said thermal printing heads 3*a* and 3*b* respectively while being guided by the guide rollers 6*a* and 6*b* respectively along and in uniform, close contact with the dye-image-receiving layers 7*a* and 7*b* respectively of the receiving sheet 2 to the winding rolls 8*a* and 8*b* respectively, said receiving sheet 2 being forwarded through sheet-guiding rollers 9*a* and 9*b* respectively and through the nip between said printing stations 1*a* and 1*b* and their backing rollers 10*a* and 10*b* respectively in the direction indicated by the arrows and at the same speed as that of the dye-donor elements 5*a* and 5*b*. The electronic control of the thermal printing heads 3*a* and 3*b* is performed by a controlling means in such a way that:

one of said thermal printing heads forms a dye image in the form of an exact mirror image of an original whereas the other forms a dye image in the true-sided or unreverted form of said original;

the thermal printing head 3*b* of the printing station 1*b* starts printing after a certain time lapse has passed subsequent to the printing by the thermal printing head 3*a* of the printing station 1*a* and in such a way that the dye image printed on the dye-image-receiving layer 7*b* of receiving sheet 2 is in perfect register with the dye image printed on the dye-image-receiving layer 7*a* of receiving sheet 2.

In case a multicolour image is to be printed, the electronic control of the thermal printing heads 3*a* and 3*b* by the controlling means is performed in such a way that the receiving sheet 2 is first printed on both sides with a first dye, generally a yellow dye, next conveyed backward to the initial position and then printed on both sides with a second dye, generally a magenta dye, in register with the image of the first dye. A third dye, usually cyan, and if desired a fourth dye, usually black, can be printed in the same way, each time after backing of the receiving sheet to the initial position.

To guarantee a perfect registering of the different dye images, sensor devices are provided in the thermal printer, which detect marks revealing the positions, on which the different dye images are to be transferred in register and which feed the detected position information to the controlling means; said marks are provided on appropriate places on each dye-image-receiving layer of the receiving sheet.

After completion of the printing of the first dye on both sides of the receiving sheet the second dye can alternatively also be printed while the receiving sheet is being conveyed backward to the initial position (reverse printing). It is self-evident that in that case the electronic image information has to be fed in reversed sequence to the thermal printing heads so that the second dye will be printed in register with the image of the first dye. The third dye will be printed on both sides of the receiving sheet while said receiving sheet is moved in the same direction as that for printing the first dye, the printing being performed in register with the images of the first and the second dye. Operating according to this method, which is particularly suitable for three-colour printing, offers the advantage that the total printing time is shortened as compared with the printing method that does not include a reverse printing step.

Figure 2:
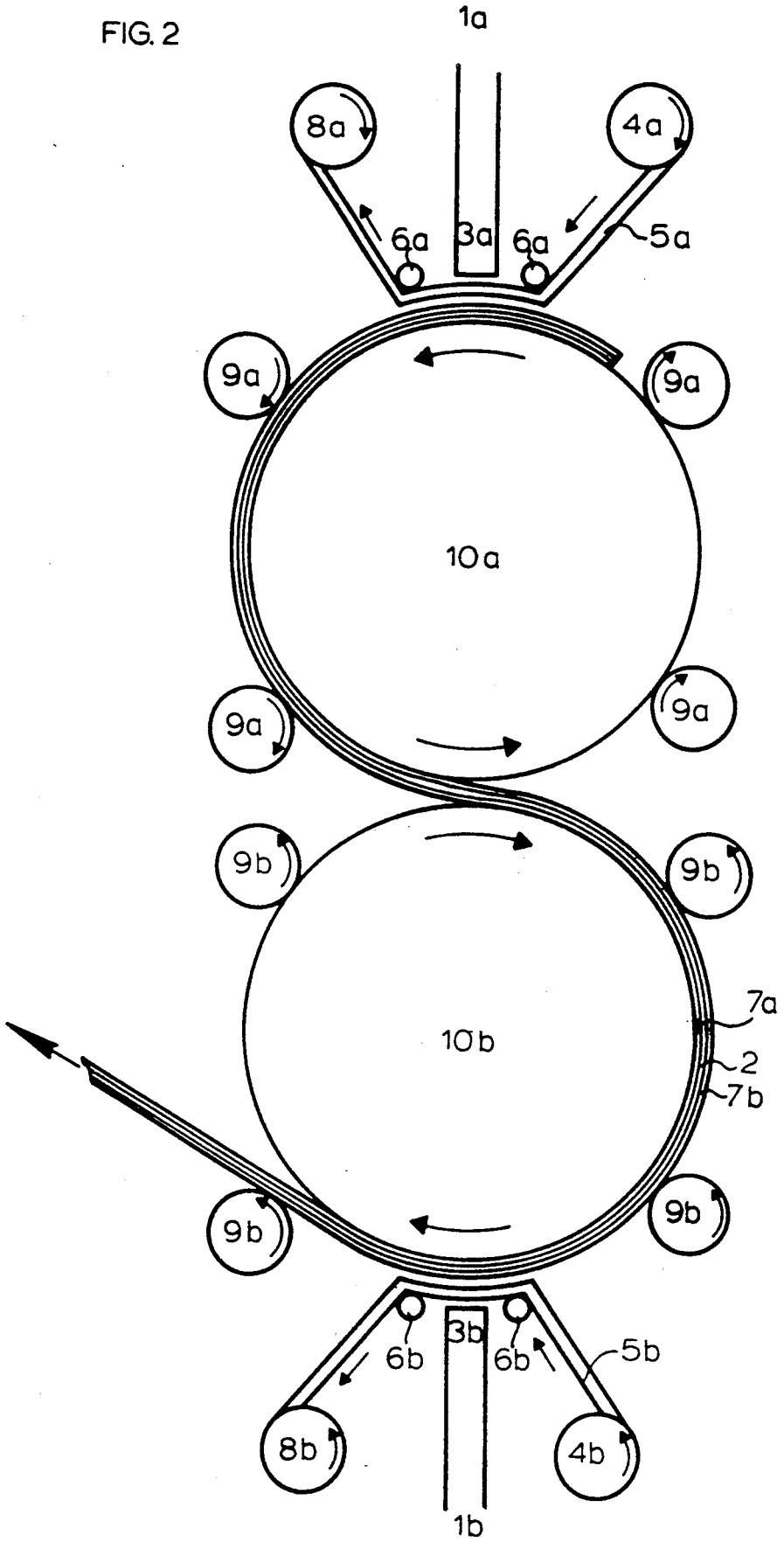
FIG. 2 illustrates schematically a modification of the thermal printer of FIG. 1 including two backing rollers rotating in opposite directions and positioned adjacent to one another so as to form a nip through which receiving sheets are fed.

According to a variant of the first alternative the thermal printer is designed as represented in FIG. 2 and comprises two backing rollers 10*a* and 10*b* rotating in opposite directions and positioned adjacent to one another so as to form a nip through which a receiving sheet 2 having two dye-image-receiving layers 7*a* and 7*b* can be fed whilst following an S-like path around said oppositely rotating backing rollers 10*a* and 10*b*, printing station 1*a* and printing station 1*b* being mounted near said backing rollers 10*a* and 10*b* respectively in such a way that said receiving sheet 2 can be forwarded in contact with dye-donor elements 5*a* and 5*b* respectively between thermal printing heads 3*a* and 3*b* and backing rollers 10*a* and 10*b* respectively, the sheet-guiding rollers 9*a* and 9*b* together with the backing rollers 10*a* and 10*b* guiding the receiving sheet 2 along said S-like path and through the nip between said printing stations 1*a* and 1*b* and their backing rollers 10*a* and 10*b* respectively in the direction indicated by the arrows and at the same speed as that of the dye-donor elements 5*a* and 5*b*, and the dye-donor elements 5*a* and 5*b* being fed by means of supply rolls 4*a* and 4*b* past said thermal printing heads 3*a* and 3*b* respectively while being guided by the rollers 6*a* and 6*b* respectively along and in contact with said dye-image-receiving layers 7*a* and 7*b* of said receiving sheet 2 to the winding rolls 8*a* and 8*b* respectively.

Figure 3:
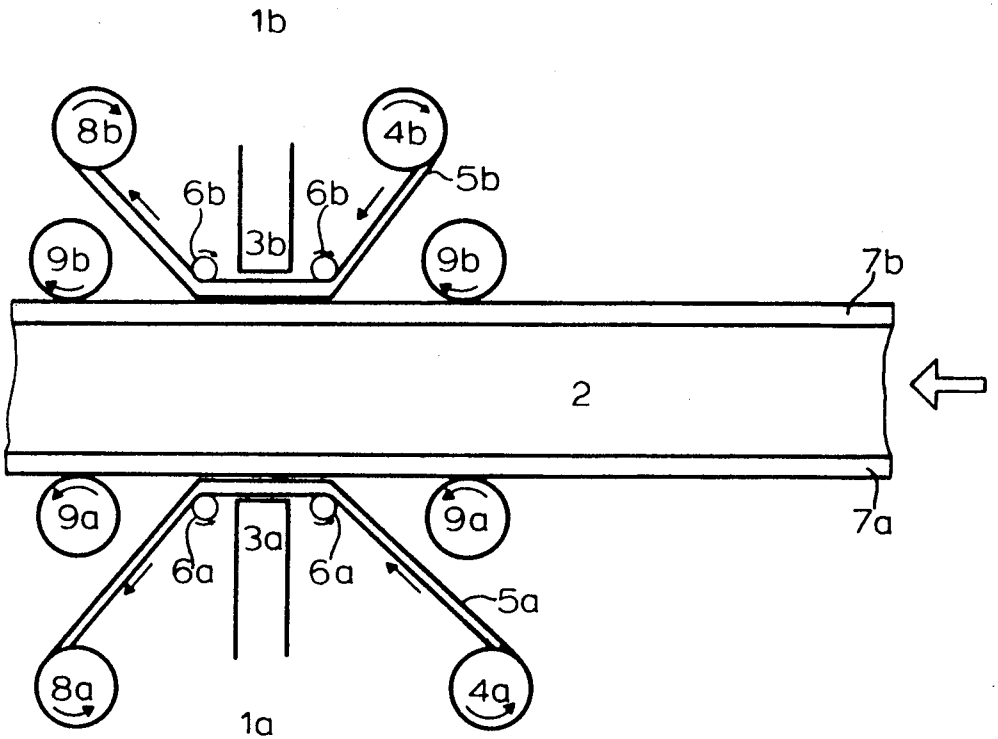
FIG. 3 illustrates schematically an alternative embodiment of the thermal printer of FIG. 1 where the printing stations are directly opposite of each other.

According to a second alternative the thermal printer is designed as represented in FIG. 3 and comprises two printing stations 1*a* and 1*b* positioned on either side of the receiving sheet 2 just opposite each other. The printing stations 1*a* and 1*b* comprise thermal printing heads 3*a* and 3*b*, supply rolls 4*a* and 4*b* that feed dye-donor elements 5*a* and 5*b* past said thermal printing heads 3*a* and 3*b* while being guided by the guide rollers 6*a* and 6*b* along and in uniform, close contact with the dye-image-receiving layers 7*a* and 7*b* of the receiving sheet 2 to the winding rolls 8*a* and 8*b*, said receiving sheet 2 being forwarded through the nip between both said printing stations 1*a* and 1*b* in the direction indicated by the arrows and at the same speed as that of the dye-donor elements 5*a* and 5*b*. The electronic control of the thermal printing heads 3*a* and 3*b* is performed by a controlling means in such a way that one of said thermal printing heads forms a dye image in the form of an exact mirror image of an original and the other simultaneously forms a dye image in the true-sided or unreverted form of said original, the mirror image and the true-sided image being printed in perfect register. According to this alternative the controlling means sends electronic image information simultaneously to both thermal printing heads so that both dye images are printed at the same time.

In order to make a transparent thermal dye transfer image having an even more increased density, a first dye-donor element is image-wise heated and a first dye image is transferred to one of both dye-image-receiving layers of a receiving sheet according to the present invention, said first dye image having a certain density, a second dye-donor element is image-wise heated and a second dye image is transferred to the other dye-image-receiving layer on the opposite side of said receiving sheet, said second dye image being of the same hue as that of said first dye image and being in register with said first dye image, another portion of the first dye-donor element or another dye-donor element is image-wise heated at least one more time and a third dye image is transferred to the side of said receiving sheet that carries said first dye image, said third dye image being of the same hue as that of said first and second dye images and being in register therewith, and another portion of the second dye-donor element or another dye-donor element is image-wise heated at least one more time and a fourth dye image is transferred to the side of said receiving sheet that carries said second dye image, said fourth dye image being of the same hue as that of said first, second, and third dye images and being in register therewith.

It is also possible to repeat the image-wise heating and transfer steps several times to further increase the density of the transferred images.

The receiving sheet for use according to the present invention comprises a transparent film carrier carrying on either side a transparent dye-image-receiving layer for receiving transferred dye. The carrier of the receiving sheet is a transparent film of e.g. polyethylene terephthalate, a polyether sulfone, a polyimide, a cellulose ester, and a polyvinyl alcohol-coacetal.

Both dye-image-receiving layers may comprise e.g. a polycarbonate, a polyurethane, a polyester, a polyamide, polyvinyl chloride, polystyrene-coacrylonitrile, polycaprolactone, and mixtures thereof. Suitable dye-image-receiving layers have been described in e.g. EP-A 0,133,011, EP-A 0,133,012, EP-A 0,144,247, EP-A 0,227,094, and EP-A 0,228,066.

Each of the dye-image-receiving layers may be present in any amount that is effective for the intended purpose. In general, favourable results are obtained at concentrations of from about 1 to about 10 g/m2.

UV-absorbers and/or antioxidants may be incorporated into the dye-image-receiving layers for improving the fastness to light and other stabilities of the recorded images.

A releasing agent that aids in separating the receiving sheet from a dye-donor element after transfer can be present in the dye-image-receiving layers. Solid waxes, fluorine- or phosphate-containing surfactants, and silicone oils can be used as releasing agent. A suitable releasing agent has been described in e.g. EP-A 0,133,012, JP 85/19138, and EP-A 0,227,092.

The receiving sheet may also be provided with detection marks so that it can be positioned accurately during dye transfer and that the dye images are formed at the exact positions.

The dye-donor elements for use according to the thermal dye transfer method of the present invention comprise printing dyes that can be released by fusion, vapourization, or sublimation. Suitable dyes have been described in e.g. EP-A 209,990, EP-A 209,991, EP-A 216,483, EP-A 218,397, EP-A 227,095, EP-A 227,096, EP-A 229,374, EP-A 235,939, EP-A 247,737, EP-A 257,577, EP-A 257,580, EP-A 258,856, EP-A 279,330, EP-A 279,467, EP-A 285,665, U.S. Pat. No. 4,743,582, U.S. Pat. No. 4,753,922, U.S. Pat. No. 4,753,923, U.S. Pat. No. 4,757,046, U.S. Pat. No. 4,769,360, U.S. Pat. No. 4,771,035, JP 84/78894, JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489.

The dyes are used in the dye/binder layer of a dye-donor element. The dye/binder layer has a thickness of about 0.2 to 5.0 um, preferably 0.4 to 2.0 um, and the amount ratio of dye to binder is from 9:1 to 1:3 by weight, preferably from 2:1 to 1:2 by weight.

The binder can be chosen from cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, cellulose triacetate, and cellulose nitrate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The dye/binder layer can also comprise other components such as e.g. curing agents, preservatives, and other ingredients, which have been described exhaustively in EP-A 0,133,011, EP-A 0,133,012, EP-A 0,111,004, and EP-A 0,279,467.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiving sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 um. If desired, the support can be coated with an adhesive or subbing layer.

The dye/binder layer of the dye-donor elements can be applied to the support by coating or by printing techniques such as a gravure process.

A dye barrier layer comprising a hydrophilic polymer can be provided between the support and the dye/binder layers of the dye-donor element to improve the dye transfer densities by preventing wrong-way transfer of dye into the support. The dye barrier layers may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065. Certain hydrophilic polymers e.g. those described in EP-A 0,227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers.

The dye-donor elements are used to form a dye transfer image having an increased density. Such a process comprises placing the dye/binder layer of a dye-donor element in face-to-face relation with the dye-receiving layer on each side of the receiving sheet and image-wise heating from the back of the donor elements. The transfer of the dye on both sides of the receiving sheet is accomplished by heating for milliseconds at a temperature that may be as high as 400° C.

When the dye transfer is performed for but one single colour, a monochrome dye transfer image is obtained.

Said monochrome dye image can be composed of a combination of dyes e.g. in the formation of black images. A multicolour image can be obtained by using dye-donor elements containing three or more primary colour dyes and sequentially performing the process steps described above for each colour.

In addition to thermal printing heads, laser light, infrared flash, or heated pins can be used as a heat source for supplying the heat energy. Thermal printing heads that can be used to transfer dye from dye-doner elements to a receiving sheet according to the present invention are commercially available. Suitable thermal printing heads are e.g. a Fujitsu Thermal Head (FTP-040 MCS001), a TDK Thermal Head F415 HH7-1089, and a Rohm Thermal Head KE 2008-F3.

Alternatively, the support of the dye-donor elements may be an electrically resistive ribbon consisting of e.g. a multilayered structure of a carbon-loaded polycarbonate coated with a thin aluminium film. Current is injected into the resistive ribbon by electrically addressing a print head electrode, thus resulting in highly localized heating of the ribbon beneath the relevant electrode. The fact that in this case the heat is generated directly in the resistive ribbon and that it is the ribbon that gets hot brings about an inherent advantage in printing speed using the resistive ribbon/electrode head technology as compared with the thermal printing head technology where the various elements of the thermal printing head get hot and must cool down before the head can print on a next position.

The following examples illustrate the present invention without limiting, however, the scope thereof.

EXAMPLE 1

A receiving sheet was made as follows.

A transparent polyethylene terephthalate film having a thickness of 175 um was coated on one side by means of a coating bar with 10 ml of a 10% by weight solution in methylene chloride of a polyester sold under the trade mark MISCHPOLYESTER T203 by the Witten Corporation. The wet thickness of the resulting dye-image-receiving layer was 50 um. The resulting layer was dried at 45° C. The dry dye-image-receiving layer was then coated with a solution of 1 g of a polysiloxane polyether copolymer in 10 ml of ethanol. The resulting coating had a wet thickness of 25 um and it was dried at 45° C. The purpose of the latter coating was to prevent the receiving sheet from sticking to the dye-donor element.

Next, the other side of the polyethylene terephthalate film was coated in the same way with an identical dye-image-receiving layer and an identical anti-sticking layer.

Commercially available Mitsubishi CP100 dye-donor elements comprising black, cyan, magenta, and yellow dye areas were used in the following comparative tests.

A colour video printer equipped with two identical printing stations comprising identical thermal printing heads arranged as shown in FIG. 1 was used to carry out these comparative tests.

The electronic control of the printing stations and the thermal printing heads was performed by a controlling means in such a way that one of the thermal printing heads (first printing head) formed a dye image in the form of an exact mirror image of an original and the second thermal printing head subsequently formed a dye image in the true-sided form and that the mirror image was in perfect register with the true-sided image.

The colour video printer was equipped with a device offering the possibility of deactivating the first printing head so that only the true-sided dye image could be printed by the second thermal printing head. The colour video printer was also equipped with sensor devices capable of detecting marks provided on each dye-image-receiving layer of the receiving sheet and feeding the detected position information to the controlling means to guarantee the perfect registering of the dye images.

The receiving sheet was printed, while being forwarded in contact with a dye-donor element on either side, through the nip between the printing stations and their backing rollers.

The receiving sheet was separated from both dye-donor elements and the density (Dmax) of the recorded dye image(s) on the receiving sheet was measured in transmission by means of a Perkin Elmer 555 Spectrofotometer (split 2.0 nm) at 445, 554, 600, and 653 nm for the black printed dye image, at 653 nm for the cyan printed dye image, at 554 nm for the magenta printed dye image, and at 445 nm for the yellow printed dye image.

In Table 1 hereinafter Dmax values (indicated with "Double") are shown, which were measured through receiving sheets printed with a dye image on either side and in register with one another. For comparison Table 1 also comprises Dmax values measured through receiving sheets printed with only one dye image by deactivating the first printing head, the measurement being done through the printed side of the receiving sheet (indicated with "Single: printed side/1") and alternatively through the opposite side of the printed side of the receiving sheets (indicated with "Single: non-printed side/1"). Table 1 also comprises Dmax values measured through receiving sheets printed with only one dye image by deactivating the second printing head, the measurement being done through the printed side of the receiving sheet (indicated with "Single: printed side/2") and alternatively through the opposite side of the printed side of the receiving sheets (indicated with "Single: non-printed side/2").

TABLE 1

| | 445 nm | 554 nm | 600 nm | 653 nm |
|---|---|---|---|---|
| Black printed dye image | | | | |
| Double | 1.322 | 1.702 | 1.872 | 1.858 |
| Single: printed side/1 | 0.730 | 0.891 | 0.966 | 0.950 |
| Single: non-printed side/1 | 0.717 | 0.862 | 0.934 | 0.920 |
| Single: printed side/2 | 0.715 | 0.866 | 0.937 | 0.919 |
| Single: non-printed side/2 | 0.687 | 0.839 | 0.909 | 0.893 |
| Cyan printed dye image | | | | |
| Double | | | | 1.848 |
| Single: printed side/1 | | | | 0.934 |
| Single: non-printed side/1 | | | | 0.934 |
| Single: printed side/2 | | | | 0.947 |
| Single: non-printed side/2 | | | | 0.980 |
| Magenta printed dye image | | | | |
| Double | | 1.470 | | |
| Single: printed side/1 | | 0.726 | | |
| Single: non-printed side/1 | | 0.761 | | |
| Single: printed side/2 | | 0.730 | | |
| Single: non-printed side/2 | | 0.767 | | |
| Yellow printed dye image | | | | |
| Double | 1.829 | | | |
| Single: printed side/1 | 0.961 | | | |
| Single: non-printed side/1 | 0.965 | | | |
| Single: printed side/2 | 1.000 | | | |
| Single: non-printed side/2 | 0.970 | | | |

EXAMPLE 2

A receiving sheet was made as described in Example 1 with the only difference that a co(styrene-acrylonitrile-butadiene) sold under the trade mark Lustran Q1355 by Monsanto, was used instead of the polyester employed in Example 1.

The receiving sheet was printed with the aid of dye-donor elements and the printer as described in Example 1.

In Table 2 hereinafter Dmax values obtained by measurement as described in Example 1 are listed.

TABLE 2

| | 445 nm | 554 nm | 600 nm | 653 nm |
|---|---|---|---|---|
| Black printed dye image | | | | |
| Double | 0.990 | 1.540 | 1.770 | 1.740 |
| Single: printed side/1 | 0.540 | 0.780 | 0.875 | 0.870 |
| Single: non-printed side/1 | 0.540 | 0.785 | 0.880 | 0.865 |
| Single: printed side/2 | 0.565 | 0.810 | 0.920 | 0.890 |
| Single: non-printed side/2 | 0.565 | 0.810 | 0.915 | 0.890 |
| Cyan printed dye image | | | | |
| Double | | | | 1.860 |
| Single: printed side/1 | | | | 0.980 |
| Single: non-printed side/1 | | | | 0.980 |
| Single: printed side/2 | | | | 1.050 |
| Single: non-printed side/2 | | | | 1.050 |
| Magenta printed dye image | | | | |
| Double | | 1.490 | | |
| Single: printed side/1 | | 0.780 | | |
| Single: non-printed side/1 | | 0.780 | | |
| Single: printed side/2 | | 0.810 | | |
| Single: non-printed side/2 | | 0.810 | | |
| Yellow printed dye image | | | | |
| Double | 1.820 | | | |
| Single: printed side/1 | 0.935 | | | |
| Single: non-printed side/1 | 0.940 | | | |
| Single: printed side/2 | 0.985 | | | |
| Single: non-printed side/2 | 0.980 | | | |

EXAMPLE 3

A receiving sheet was made as described in Example 1 with the difference that a co(vinyl chloride-vinyl acetate) sold under the trade mark SOLVIC 560 RA by Solvic was used instead of the polyester employed in Example 1 and that ethyl methyl ketone was used as solvent therefor.

The receiving sheet was printed with the aid of dye-donor elements and the printer as described in Example 1.

In Table 3 hereinafter Dmax values obtained by measurement as described in Example 1 are listed.

TABLE 3

| | 445 nm | 554 nm | 600 nm | 653 nm |
|---|---|---|---|---|
| Black printed dye image | | | | |
| Double | 1.620 | 2.440 | 2.450 | 2.330 |
| Single: printed side/1 | 0.850 | 1.195 | 1.230 | 1.170 |
| Single: non-printed side/1 | 0.850 | 1.200 | 1.220 | 1.165 |
| Single: printed side/2 | 0.875 | 1.225 | 1.250 | 1.180 |
| Single: non-printed side/2 | 0.875 | 1.220 | 1.250 | 1.180 |
| Cyan printed dye image | | | | |
| Double | | | | 2.770 |
| Single: printed side/1 | | | | 1.330 |
| Single: non-printed side/1 | | | | 1.325 |
| Single: printed side/2 | | | | 1.430 |
| Single: non-printed side/2 | | | | 1.435 |
| Magenta printed dye image | | | | |
| Double | | 2.260 | | |
| Single: printed side/1 | | 1.050 | | |
| Single: non-printed side/1 | | 1.055 | | |
| Single: printed side/2 | | 1.130 | | |
| Single: non-printed side/2 | | 1.120 | | |

TABLE 3-continued

| | 445 nm | 554 nm | 600 nm | 653 nm |
|---|---|---|---|---|
| Yellow printed dye image | | | | |
| Double | 2.200 | | | |
| Single: printed side/1 | 1.130 | | | |
| Single: non-printed side/1 | 1.130 | | | |
| Single: printed side/2 | 1.180 | | | |
| Single: non-printed side/2 | 1.180 | | | |

EXAMPLE 4

A receiving sheet was made as described in Example 1 with the difference that a polycarbonate sold under the trade mark MAKROLON 2405 by Bayer was used instead of the polyester employed in Example 1.

The receiving sheet was printed with the aid of dye-donor elements and the printer as described in Example 1.

In Table 4 hereinafter Dmax values obtained by measurement as described in Example 1 are listed.

TABLE 4

| | 445 nm | 554 nm | 600 nm | 653 nm |
|---|---|---|---|---|
| Black printed dye image | | | | |
| Double | 1.150 | 2.500 | 2.950 | 2.830 |
| Single: printed side/1 | 0.600 | 1.310 | 1.610 | 1.550 |
| Single: non-printed side/1 | 0.590 | 1.310 | 1.630 | 1.590 |
| Single: printed side/2 | 0.600 | 1.300 | 1.420 | 1.420 |
| Single: non-printed side/2 | 0.590 | 1.300 | 1.450 | 1.400 |
| Cyan printed dye image | | | | |
| Double | | | | 2.980 |
| Single: printed side/1 | | | | 1.610 |
| Single: non-printed side/1 | | | | 1.610 |
| Single: printed side/2 | | | | 1.500 |
| Single: non-printed side/2 | | | | 1.500 |
| Magenta printed dye image | | | | |
| Double | | 2.320 | | |
| Single: printed side/1 | | 1.410 | | |
| Single: non-printed side/1 | | 1.400 | | |
| Single: printed side/2 | | 1.150 | | |
| Single: non-printed side/2 | | 1.130 | | |
| Yellow printed dye image | | | | |
| Double | 1.810 | | | |
| Single: printed side/1 | 0.975 | | | |
| Single: non-printed side/1 | 0.970 | | | |
| Single: printed side/2 | 0.920 | | | |
| Single: non-printed side/2 | 0.920 | | | |

EXAMPLE 5

A receiving sheet was made as described in Example 1. The receiving sheet was printed with the aid of dye-donor elements and the printer as described in Example 1.

The receiving sheet was separated from both dye-donor elements and the density (Dmax) of the recorded dye image(s) on the receiving sheet was measured in transmission for each colour and for black by means of a Quantalog Densitometer through the coloured filters as indicated between parentheses in Table 5 hereinafter.

In Table 5 Dmax values (indicated with "Double") are shown, which were measured through the receiving sheet printed with a dye image on either side and in register with one another. For comparison Table 5 also comprises Dmax values (indicated with "Single"), which were measured through a receiving sheet printed with only one dye image by deactivating the first printing head.

Table 5 also shows results obtained by repeating the image-wise heating and transfer steps once or twice to further increase the density of the transferred images.

They are indicated with "2nd passage" and "3rd passage".

TABLE 5

| | Black (none) | Yellow (blue) | Magenta (green) | Cyan (red) |
|---|---|---|---|---|
| Single | 0.69 | 0.72 | 0.90 | 0.72 |
| Double | 1.29 | 1.23 | 1.68 | 1.29 |
| Single (2nd passage) | 0.97 | 1.06 | 1.45 | 1.03 |
| Double (2nd passage) | 1.82 | 1.93 | 2.80 | 1.95 |
| Single (3rd passage) | 1.30 | 1.30 | 1.83 | 1.32 |
| Double (3rd passage) | 2.47 | 2.44 | 3.60 | 2.51 |

I claim:

1. Method for making a transparent thermal dye transfer image comprising:

image-wise heating a first dye-donor element comprising a support having thereon a dye-binder layer and transferring a first dye image to a dye-image-receiving layer provided on one side of the transparent film carrier of a receiving sheet, said first dye image having a certain density, image-wise heating a second dye-donor element comprising a support having thereon a dye-binder layer and transferring a second dye image of the same hue as that of said first dye image to a dye-image-receiving layer provided on the other side of said transparent film carrier of said receiving sheet, such that said second dye image is a mirror image of said first dye image and is in register with said first dye image to increase the density of said first dye image.

2. A method according to claim 1, wherein said image-wise heating is performed with thermal printing heads of a video printing device.

3. A method according to claim 2, wherein said image-wise heating steps by means of thermal printing heads are controlled by a controlling means in such a way that said first dye image is transferred in the form of an exact mirror image of an original image to be printed, to said dye-image-receiving layer provided on one side of said receiving sheet and said second dye image is transferred in the form of its true-sided image, which is identical to said original image to be printed, to said other dye-image-receiving layer provided on the opposite side of said receiving sheet, said mirror image and said true-sided image being of the same hue and being in register to increase the density of said transparent thermal dye transfer image obtained.

4. A method according to claim 3, wherein said support of said first and of said second dye-donor elements has been coated on both sides with an adhesive layer, one adhesive layer being covered with a slipping layer to prevent said thermal printing heads from sticking to said first and to said second dye-donor element, the other adhesive layer at the opposite side of said support being covered with said dye-binder layer, which contains printing dyes in a form that can be released by fusion, sublimation, or vapourization in varying amounts depending on how much heat is applied to said first and to said second dye-donor element.

5. A method according to claim 3, wherein the register of said mirror image and said true-sided image is accomplished by providing said first and said second dye-donor elements with marks for detecting the positions of the transferable dye areas and wherein said video printing device comprising the thermal printing heads is equipped with mark-detecting sensor devices that feed detected mark information to said controlling means.

6. A method according to claim 1, wherein the image-wise heating of said second dye-donor element is performed simultaneously with the image-wise heating of said first dye-donor element.

7. A method according to claim 1, wherein said image-wise heating and transfer steps are repeated several times to further increase the density of the transferred dye images.

8. A method according to claim 1, wherein the image-wise heating of said second dye-donor element is performed separately from the image-wise heating of said first dye-donor element.

9. Imaged article comprising a transparent film carrier provided on each side with a transparent dye image layer, wherein the dye image layer on one side of said transparent film carrier carries a transferred first dye image having a certain density and the dye image layer on the other side of said transparent film carrier carries a transferred second dye image of the same hue as that of said first dye image, said second dye image being a mirror image of said first dye image and being in register with said first dye image to increase the density thereof.

* * * * *